United States Patent [19]

Simeth

[11] 4,404,908

[45] Sep. 20, 1983

[54] ARRANGEMENT FOR SUPPLYING INK TO THE PRINTING PLATE OF A PRINTING PRESS

[75] Inventor: Claus Simeth, Offenbach am Main, Fed. Rep. of Germany

[73] Assignee: M.A.N.-Roland Druckmaschinen Aktiengsellschaft, Offenbach am Main, Fed. Rep. of Germany

[21] Appl. No.: 390,276

[22] Filed: Jun. 21, 1982

[30] Foreign Application Priority Data

Jun. 27, 1981 [DE] Fed. Rep. of Germany ..... 3125434

[51] Int. Cl.[3] ..... B41F 7/24; B41F 31/00

[52] U.S. Cl. ..... 101/349; 101/148

[58] Field of Search ..... 101/148, 348, 349, 350, 101/351, 352, 207, 208, 209, 210, 202; 118/257

[56] References Cited

U.S. PATENT DOCUMENTS 688,172 12/1901 Hawes ..... 101/202 X
2,622,522 12/1952 Trozmuller ..... 101/171
2,821,133 1/1958 Brodie ..... 101/349 X

FOREIGN PATENT DOCUMENTS 2412412 9/1975 Fed. Rep. of Germany .

*Primary Examiner*—J. Reed Fisher

*Attorney, Agent, or Firm*—Leydig, Voit, Osann, Mayer & Holt, Ltd.

[57] ABSTRACT

An inking system for a lithographic printing press in which the plate has a non-ink accepting column position. Ink from an ink fountain is conveyed to the plate over its full width by a series of roller elements including an ink drum and ending with a form roller which is in rolling engagement with the plate. Water from a water fountain is conveyed to the plate by a series of rollers ending with a water form roller. A sub-frame is positioned at the non-ink accepting column position. The sub-frame mounts a pair of guide rollers supporting a relatively narrow endless belt in an elongated loop, the belt presenting a flat ink-accepting surface. A relatively narrow roller segment couples one end of the loop to the plate while the other end of the loop is coupled to the ink drum so that the belt forms an ink "bridge" on the downstream side of the series of ink rollers. Thus any ink which may become emulsified and which may therefore be deposited on the plate in non-ink accepting areas is picked off of the plate and conveyed by the belt back to the ink drum. In the preferred embodiment the narrow roller segment is journalled in a pair of arms which are swingable on the sub-frame about the axis of the adjacent one of the guide rollers with provision for adjusting the pressure exerted by the roller segment against the plate on the plate cylinder.

6 Claims, 4 Drawing Figures

ARRANGEMENT FOR SUPPLYING INK TO THE PRINTING PLATE OF A PRINTING PRESS

In a conventional lithographic press a film of water or other dampening fluid is supplied across the entire width of the plate. This is followed by application of a film of ink across the entire width of the plate so that the ink clings only to the ink-accepting areas. Such an arrangement works well where the printing density in each of the column positions across the width of the sheet is approximately the same, as it is, for example, when solid columns of text are being printed. In the printing of different typography, however, a certain column position may be nearly or completely blank so that no ink is required in such column position. Thus, ink tends to accumulate upon the rollers in the non-ink accepting column position, and the water being constantly fed in such column position mixes with the ink on the rollers resulting in emulsification. If the emulsification progresses far enough the result will be the application of emulsified ink to areas of the plate which are normally non-ink accepting and thus to ink-free areas of the sheets being printed resulting in spoiled sheets. In a conventional press, before the non-ink accepting areas on the plate in the particular column position become contaminated, it is the practice to stop the press for a washing down of the inking system.

The problem of emulsification, and the down time required for washing the system, has long been recognized and efforts have been made in the design of the press to increase the useful printing time before substantial emulsification occurs and wash down becomes necessary. For example, in German Pat. No. 24 12 412 it is taught to employ a roller in an inking system which departs from a straight cylinder so that the ink which tends to accumulate in a column position, and which therefore tends to become emulsified, is squeezed laterally into an adjacent column position. Unfortunately, this solution to the problem is impractical since the device does not act selectively with respect to any column position, or positions, across the width of the sheet which may be ink-free. To make the device selective, it would be necessary to provide a large number of selectable, specially profiled rollers each having an enlargement or ridge in the ink-free column position, or positions, corresponding to the material to be printed.

Accordingly, it is an object of the present invention to provide an inking system for a lithographic press for use with a plate having one or more non-ink accepting column positions in which the emulsification of the ink which tends to occur at the non-ink accepting column positions is overcome thereby substantially increasing the length of useful printing time which is attainable before shut-down of the press, and washing of the inking system, becomes necessary.

It is a related object of the present invention to provide an attachment for a conventional lithographic press which may be selectively placed in the inking system at any non-ink accepting column position to avoid the effect of accumulation and emulsification of ink which tends to occur in that column position.

More specifically, it is an object of the present invention to provide an ink bridge in the form of a narrow loop of belt located in the non-ink accepting column position and which serves as a path for ink flow between the plate and a drum in the inking system so that any emulsified ink which tends to be deposited in the non-ink accepting areas of the plate in the column position is picked off and transferred back within the inking system thereby keeping the plate clear of unwanted deposits of emulsified ink.

Even more specifically it is an object of the invention to provide a narrow ink bridge which is mounted in a laterally positionable sub-frame closely adjacent the downstream side of a conventional inking system and which may be selectively repositioned in any non-ink accepting column position. Indeed, a plurality of such sub-frames may be employed side-by-side to service a plurality of non-ink accepting column positions on the sheet.

Other objects and advantages of the invention will become apparent upon reading the attached detailed description and upon reference to the drawings in which.

While the invention has been described in connection with a preferred embodiment, it will be understood that I do not intend to be limited to the particular embodiment shown but I do intend, on the contrary, to cover the various alternative and equivalent constructions included within the spirit and scope of the appended claims.

In a conventional lithographic press, films of water and ink are applied in succession to a printing plate having ink-accepting and non-ink accepting areas. The ink clinging to the ink-accepting areas is transferred, or "offset," onto a resilient blanket cylinder which applies the inked impression to a sheet passing between the blanket cylinder and a third, or impression, cylinder.

Figure 1:
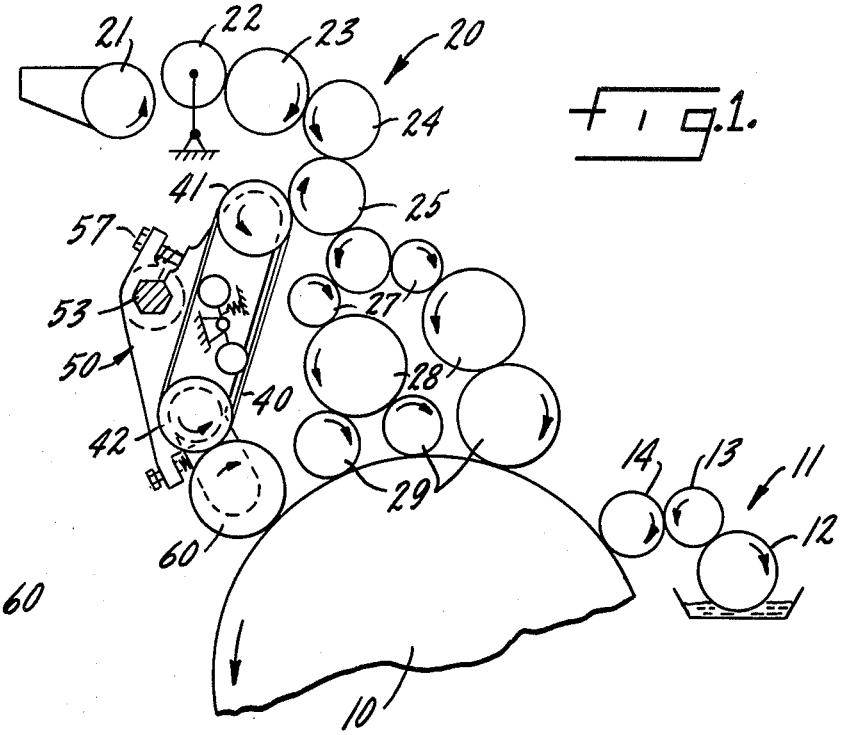
FIG. 1 is a diagrammatic elevation showing an inking system incorporating the present invention with an associated dampening system.
Figure 4:
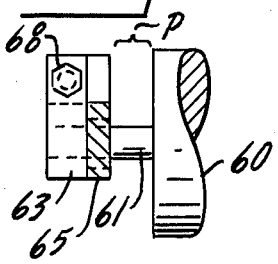
FIG. 4 is a fragmentary section taken along line 4—4 in FIG. 2.
Figure 2:
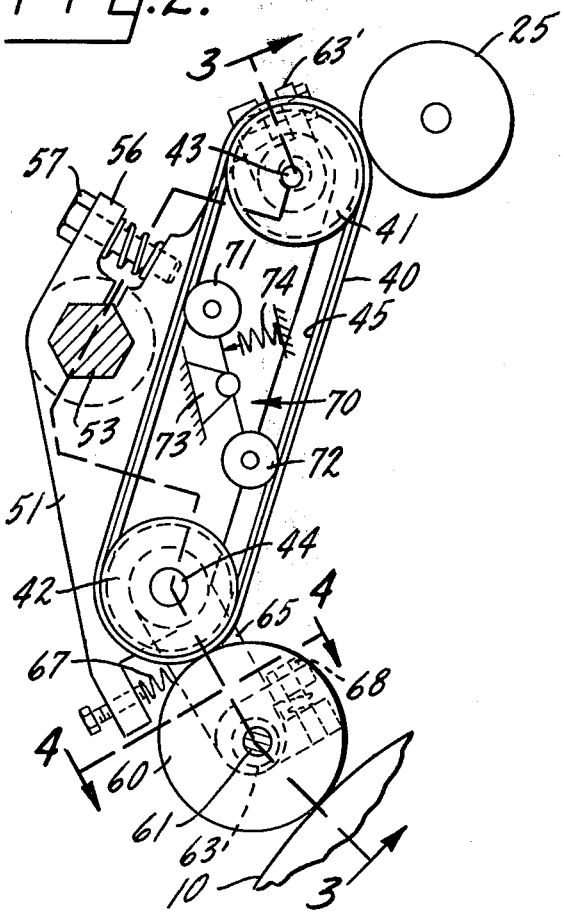
FIG. 2 is another elevational view based upon an enlarged portion of FIG. 1 and looking along section line 2—2 in FIG. 3.

In FIG. 1 of the drawings only the plate cylinder, indicated at 10, has been shown. The plate cylinder will be understood to have a thin metal plate mounted on the surface thereof to which the films of water and ink are successively applied. Water is derived from a dampening system indicated generally at 11 formed of a water fountain roller 12, a transfer roller 13 and a water form roller 14.

The usual inking system, shown generally at 20, is somewhat more involved. It includes a fountain roller 21, an oscillated ductor roller 22 and transfer rollers 23, 24 leading to an ink drum 25, the ink drum being located relatively early in the series of inking rollers. From the ink drum 25 an ink film passes to an ink roller 26 from which the ink film is fed, by a pair of rollers 27, to a pair of drums 28 which, in turn, feed the ink film to the surface of the plate by means of a set of ink form rollers 29. The ink form rollers serve to apply an ink film to the plate over the entire axial width of the plate.

As long as approximately the same amount of ink is consumed by the plate in each of its column positions per unit of time, a lithographic press is capable of running more or less indefinitely without necessity for shutting down the press to wash, and renew, the inking system. However, when certain column positions are largely, or entirely, non-ink accepting, ink tends to accumulate in those column positions. Accumulated ink absorbs the water being fed in those column positions by the dampening system, resulting in emulsification of the ink. In due course the emulsified ink tends to be unwantedly deposited upon the plate in non-ink accepting areas thereby spoiling the printed product and requiring a washing down of the system to restore the flow of clean, non-emulsified ink.

In accordance with the present invention an ink bridge is selectively provided in the non-ink accepting column position, or positions, in the form of a relatively narrow endless belt, the belt being supported upon a pair of correspondingly narrow guide rollers widely spaced from one another to form the belt into an elongated loop, the guide rollers being journalled in a shiftable sub-frame, with one end of the loop being in ink-transferring relationship with the printing plate closely adjacent the downstream side of the inking system to remove from the plate by any ink, particularly any emulsified ink, which may be applied by the ink form roller to the non-ink accepting areas in the column position. The other end of the loop is in ink-transferring relationship to an ink drum in the inking system for constantly transferring the removed ink to the drum thereby to avoid, or at least delay, contamination of the non-inked areas of the plate in the non-ink accepting column position.

Thus, turning to the drawings, I provide an endless belt 40 made of suitable ink-accepting flexible material, such as plastic, which is trained about an upper guide roller 41 and a lower guide roller 42, the rollers having respective axles 43, 44. To ensure that the belt is maintained in a centered tracking position, the belt is provided with at least one integral ridge 45 extending longitudinally of the belt along its inner surface, each ridge engaging a respective annular groove 46 formed in the guide rollers.

The guide rollers are journalled in a sub-frame generally indicated at 50 and which includes laterally spaced plates 51, 52. The sub-frame is mounted upon a hexagonal bar 53 which extends between, and which is rigidly supported by, the vertical members 54, 55 of the main frame (not shown). A clamp 56, which forms a part of the plate 51, and which has a clamping screw 57, serves to hold the sub-frame 50 rigidly in the selected column position.

For the purpose of coupling the lower end of the belt loop to the plate on the plate cylinder, a narrow roller segment 60 is provided made of, or surfaced with, ink accepting material and having an axle 61. The axle is journalled in a pair of bearing sleeves 63, 64 which are mounted in a pair of swingable arms 65, 66 which are centered for swinging movement about the axle 44 of the adjacent guide roller 42. Springs 67 are interposed between the plates 51, 52 of the sub-frame and the respective arms 65, 66 for urging the roller segment 60 in the direction of the plate cylinder. For adjusting the roller segment 60 so that it bears evenly against the belt and the plate in the plate cylinder over the axial length of the segment, the bearing sleeves 63, 64 are formed eccentrically and are rockably adjustable by means of adjusting screws 68, 69.

At the upper end of the belt loop the belt makes direct contact with the ink drum 25. In order to ensure that the belt bears evenly on the ink drum over the width of the belt, and with the proper pressure, the axle 43 of the guide roller 41 is supported in adjustable eccentric sleeves 63', 64' which are constructed similar to the eccentric sleeves 63, 64 referred to above. Since the adjustment of the axle 43 tends to change the center-to-center distance between the axes of the guide rollers, a belt tensioning assembly 70 is provided within the belt including a pair of idler rollers 71, 72 mounted teeter-totter fashion on a central support 73, the assembly being biased by a compression spring 74 in a direction to increase the width dimension of the loop. As a result, the belt tension is maintained substantially constant over the normal range of roller adjustment.

Figure 3:
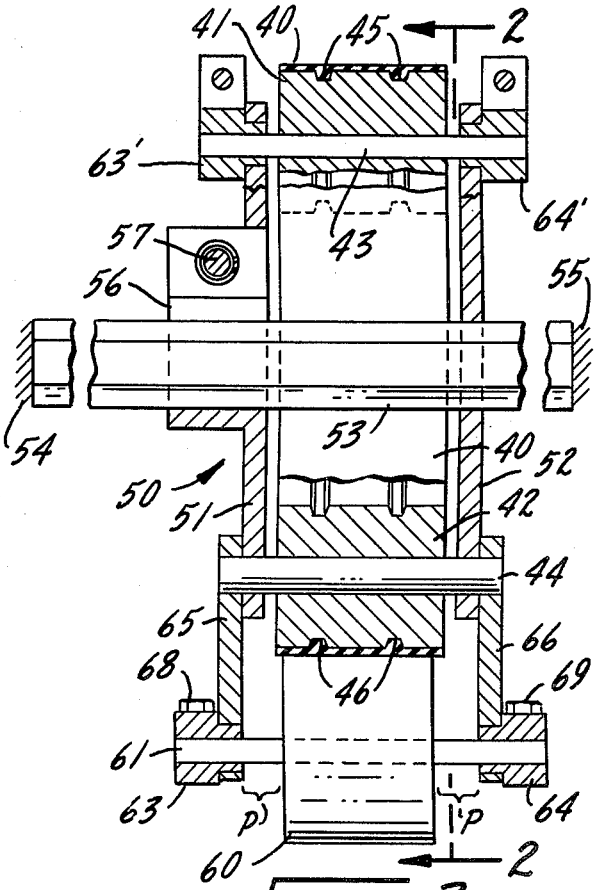
FIG. 3 is a sectional view taken along the broken section line 3—3 in FIG. 2.

It is one of the features of the construction that the narrow roller segment 60 which is in rolling engagement with the printing plate, has axial play p (FIG. 3) with respect to its supporting bearings 63, 64. It is found that the resulting freedom of axial movement causes the roller segment 60 to axially reciprocate back and forth either on a regular or random basis thereby blurring the edges of the roller segment and causing a graduated transition with respect to the adjacent column positions.

In operation, the belt 40 and associated roller segment 60, which perform the bridging function, are rotated at press speed by the ink drum 25 and by reason of rolling engagement with respect to the printing plate. Assuming that the column position with which the bridge is aligned, is non-ink accepting, the ink will tend to accumulate on the inking rollers in that column position, and because of the continuous feed of dampening fluid in the column position, the accumulated ink will tend to become emulsified. A small portion of such emulsified ink will, if the condition proceeds far enough, tend to adhere to the normally non-ink accepting area of the plate in the column position. However, when this bit of unwanted ink is engaged by the surface of the roller segment 60, it is "picked off" of the surface of the plate and passed, by the belt 40, back to the ink drum 25 to which it is transferred in successive revolutions of the belt. When the bit of emulsified ink joins the flow of clean ink from the ink fountain it loses its identity as emulsified ink and is recycled in a diluted form through the remainder of the inking system. Note that in addition to the transfer of unwanted emulsified ink from normally un-inked areas of the plate back to the drum, there is a constant flow of fresh ink from the drum via the belt to the surface of the roller segment 60 so that the surface of the roller segment is constantly renewed with fresh ink. Each unwanted bit of emulsified ink on the printing plate has a decision to make: Shall it (a) continue to cling to the plate to show up in the printed product or (b) allow itself to be picked off by the surface of the roller segment. Since the roller segment is being constantly renewed with fresh ink via the belt and since the emulsified ink has a greater attraction for fresh ink than it has to the non-ink accepting surface of the printing plate, there is a decisive transfer to the roller segment resulting in constant and perfect "clean-up" of the engaged portion of the printing plate. This self-cleaning effect enables the printing run to be extended far beyond its normal length before there is risk of defacing the printed product with emulsified ink. In other words, the press may be run for a longer period of time before washing down of the system becomes necessary. The "down" time per hour of normal printing is thereby reduced resulting in a proportionate reduction in printing costs.

In a subsequent run, having a non-ink accepting column in a different position, all that is necessary is to unscrew the clamping screw 57 and to slide the sub-frame to a new position along the hexagonal bar 53. Where there are two or more columns which are non-ink accepting, additional bridging assemblies may be used clamped to the bar 53 in respectively aligned positions.

The term "column position" has been used for convenience to denote any localized longitudinally extending region in the width dimension of the sheet. The rotating element 25 in the regular inking system has been referred to as a "drum". However, it will be understood that as used here in the term shall include any cylindrical rotating element which communicates with the bridge and which serves both as a source of fresh ink and as a "sink" for recycled emulsified ink.

It will be apparent that the objects of the invention have been amply fulfilled. Long printing runs can be attained for materials having great disparity of printing density in respective column positions, materials which cause operating problems in a normal press. The bridging sub-assembly which results in the described improvement is simple and economical to construct, easy to install and requires no special maintenance. It is one of the features of the device that it may be used, by retrofitting, in presses of existing conventional designs and which may already be in operation in the field.

I claim:

1. In an inking system for a lithographic printing press, the combination comprising a main frame, a plate cylinder journalled in the main frame and having a plate mounted thereon, the plate having a non-ink accepting column position, a source of dampening fluid having means for applying dampening fluid the width of the plate, a source of ink, an ink form roller in rolling engagement with the plate, means including a series of rollers for conveying a film of ink from the source to the form roller for applying ink the width of the plate accompanied by a tendency toward emulsification of the ink on the form roller in the non-ink accepting column position, the conveying means also including an ink drum interposed early in the series of rollers, a relatively narrow endless ink belt presenting a flat ink-accepting surface in the non-ink accepting column position, a pair of correspondingly narrow guide rollers widely spaced from one another for supporting the belt in an elongated loop, a subframe for journalling the guide rollers, means for mounting the subframe on the main frame including provision for lateral adjustment of position, one end of the loop being in ink-transferring relationship with the printing plate at a position adjacent the downstream side of the form roller to remove from the plate ink, particularly any emulsified ink, which may be applied by the form roller to the non-ink accepting areas in the column position, the other end of the loop being in ink-transferring relationship to the ink drum for constantly transferring the removed ink to the drum thereby to prevent contamination of non-inked areas of the plate in the non-ink accepting column position.

2. In an inking system for a lithographic printing press, the combination comprising a main frame, a plate cylinder journalled in the main frame and having a plate mounted thereon, the plate having a non-ink accepting column position, a source of dampening fluid having means for applying dampening fluid the width of the plate, a source of ink, an ink form roller in rolling engagement with the plate, means including a series of rollers for conveying a film of ink from the source to the form roller for applying ink the width of the plate accompanied by a tendency toward emulsification of the ink on the form roller in the non-ink accepting column position, the conveying means also including an ink drum interposed early in the series of rollers, a relatively narrow endless ink belt presenting a flat ink-accepting surface, a pair of correspondingly narrow guide rollers widely spaced from one another for supporting the belt in an elongated loop, a subframe for journalling the guide rollers, a cross bar on the main frame, the subframe being slidable on the cross bar into a position in which the narrow ink belt is aligned with the non-ink accepting column position on the plate, a narrow roller segment on the subframe, said roller segment being in rolling engagement with the plate at a position adjacent the downstream side of the form roller and also in rolling engagement with one end of the loop of belt to remove from the plate ink, particularly any emulsified ink, which may be applied by the form roller to the non-ink accepting areas in the column position, the other end of the loop being in ink-transferring relationship to the ink drum for transferring the removed ink to the drum thereby to prevent contamination of non-inked areas of the plate in the non-ink accepting column position.

3. The combination as claimed in claim 2 in which the narrow roller segment is journalled in a pair of arms, the arms being swingable on the subframe about the axis of the adjacent one of the guide rollers, and means for varying the angular position of the arms with respect to the subframe thereby to adjust the pressure exerted by the roller segment against the plate on the plate cylinder.

4. The combination as claimed in claim 1 or in claim 2 including means for adjusting the guide roller which is associated with the ink drum in a transaxial direction with respect to the subframe thereby to vary the pressure exerted between the belt and the drum, and means including a spring pressed idler roller included within the loop of belt for maintaining the belt under tension for all adjusted positions of the associated guide roller.

5. The combination as claimed in claim 1 or in claim 2 in which the ink belt is provided with at least one integral ridge extending longitudinally of the belt along its inner surface and in which the guide rollers are each provided with an annular groove for receiving the ridge for thereby maintaining the belt in a centered tracking position with respect to the guide rollers.

6. The combination as claimed in claim 2 in which the roller segment is mounted in the subframe for axial play to permit reciprocation of the roller segment through a limited distance as it is driven by the belt and by rolling engagement with the printing plate.

* * * * *